United States Patent [19]

Kunh et al.

[11] Patent Number: 5,069,496

[45] Date of Patent: Dec. 3, 1991

[54] CHAIR WITH ADJUSTABLE SEAT AND BACK REST

[76] Inventors: Günther Kunh, Bliesstrasse 80, D-6680 Neunkirchen; Ullrich Kuhn, Konrad-Adenauer-Weg 4, D-6682 Ottweiler, both of Fed. Rep. of Germany

[21] Appl. No.: 421,522

[22] Filed: Oct. 13, 1989

[30] Foreign Application Priority Data

Oct. 14, 1988 [DE] Fed. Rep. of Germany ..... 3835003

[51] Int. Cl.[5] ..... H47C 3/00

[52] U.S. Cl. ..... 297/300; 297/306; 297/345; 267/158

[58] Field of Search ..... 297/300, 306, 345, 361, 297/301; 267/158

[56] References Cited

U.S. PATENT DOCUMENTS

| | | | |
|---|---|---|---|
| 2,019,138 | 10/1935 | Kliesrath et al. | 267/158 |
| 4,200,332 | 4/1980 | Bräuning | 297/304 |
| 4,408,800 | 10/1983 | Knapp | 297/306 |
| 4,537,445 | 8/1985 | Neuhoff | 297/300 |
| 4,561,693 | 12/1985 | Brownlie et al. | 297/306 |
| 4,603,905 | 8/1986 | Stucki | 297/306 |
| 4,747,640 | 5/1988 | Locher | 297/300 |
| 4,900,085 | 2/1990 | Tobler | 297/219 |

FOREIGN PATENT DOCUMENTS 8625711 12/1986 Fed. Rep. of Germany .

*Primary Examiner*—Kenneth J. Dorner
*Assistant Examiner*—James M. Gardner
*Attorney, Agent, or Firm*—Peter K. Kontler

[57] ABSTRACT

A chair wherein the leg contains a gas spring which can be actuated to raise or lower a carrier for the seat and back rest. The seat is rigid wtih the carrier but the back rest is pivotally connected with the seat by hinge which contains a torque bar tending to pivot the back rest forwardly. Such pivoting of the back rest is normally prevented by a damper which operates between the carrier and a support at the lower end of the back rest and can be blocked to maintain the back rest in a selected angular position. The damper can be unblocked by a first mechanism at one side of and beneath the seat, and the gas spring can be activated by a mechanism beneath the other side of the seat.

20 Claims, 4 Drawing Sheets

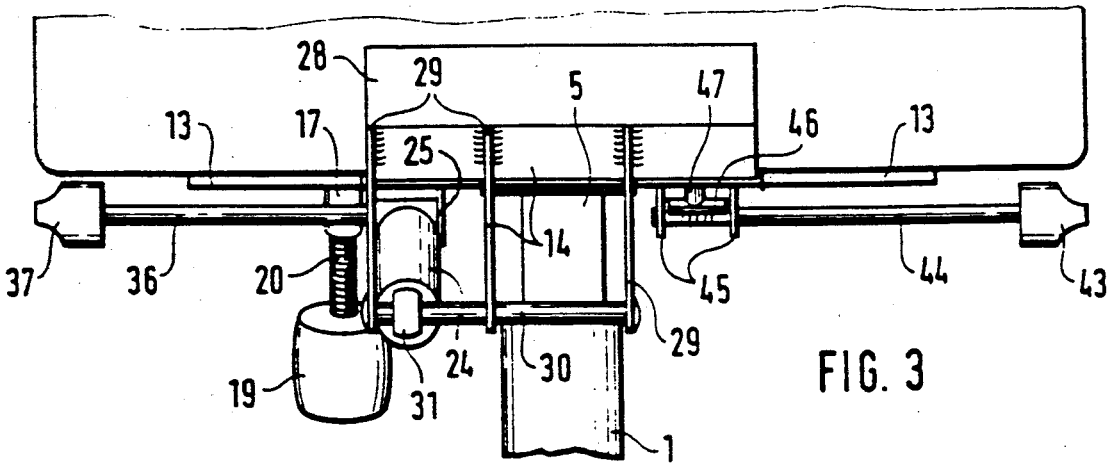
FIG. 3
FIG. 4
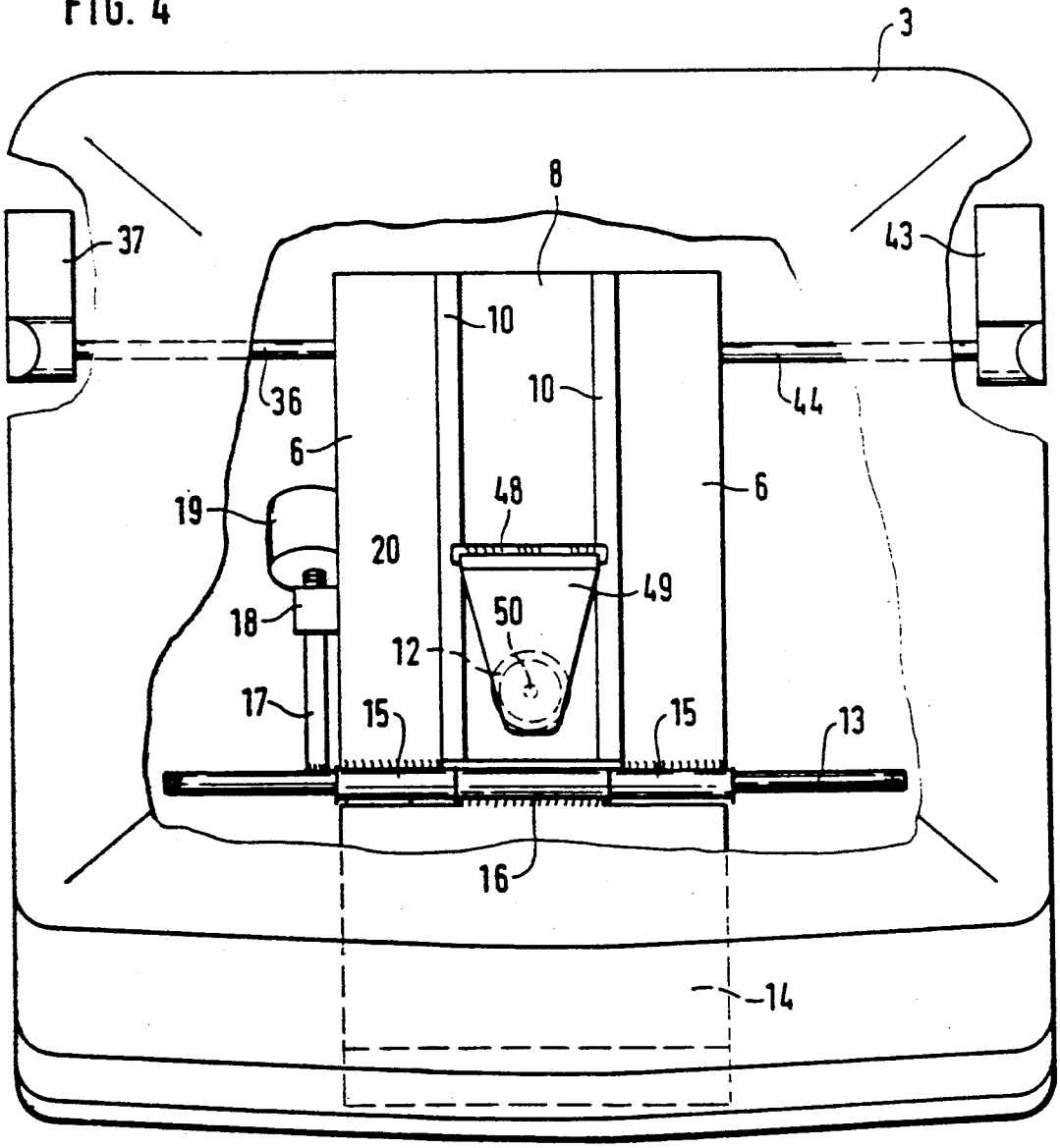

CHAIR WITH ADJUSTABLE SEAT AND BACK REST

BACKGROUND OF THE INVENTION

The invention relates to chairs in general, and more particularly to improvements in chairs with pivotable back rests and with mechanisms for changing the level of the seat and back rest. Such chairs can be employed in offices and other business establishments but can be used with equal of similar advantages in private homes, convalescent homes, hospitals, nursing homes and sanitaria.

German Utility Model No. 86 25 711 discloses a chair wherein a leg supports a seat and a mobile back rest and wherein the level of the seat and back rest can be changed by means of a gas spring in the leg. It is further known to provide a chair which includes a mobile back rest and a gas spring with a damper which yieldably opposes movements of the back rest with reference to the seat. The back rest can be arrested in any one of a plurality of different angular positions. A drawback of presently known chairs of the above outlined character is that the mechanisms which are used to pivotally mount the back rest, which enable the seat and the back rest to move up and down, and which enable the occupant of the seat to arrest the back rest in a selected angular position are too bulky, too complex and too expensive.

OBJECTS OF THE INVENTION

An object of the invention is to provide a chair which is adjustable in a number of different ways and is simpler and less expensive than, but just as versatile as, heretofore known adjustable chairs.

Another object of the invention is to provide the chair with novel and improved means for movably mounting the back rest and with novel and improved means for selectively releasing the back rest for movement to a different position with reference to the seat.

A further object of the invention is to provide a simple, compact and inexpensive but versatile mechanism which enables the occupant of the chair to change the level of the seat and back rest as well as to change the orientation of the back rest with reference to the seat.

An additional object of the invention is to provide the chair with novel and improved means for controlling the operation of the damper which yieldably opposes pivoting of the back rest relative to the seat.

Still another object of the invention is to provide a novel and improved connection between the leg, the back rest and the seat of the above outlined chair.

SUMMARY OF THE INVENTION

The invention is embodied in a chair which comprises a leg, a seat, a back rest, a carrier which connects the seat to the upper portion of the leg and is rigid with the upper portion of the leg as well as with the seat, a hinge which pivotally mounts the back rest on the carrier and includes means (e.g., a torque rod) for biasing the back rest forwardly, and means for movably coupling the back rest to the carrier. The coupling means consists of a support which is rigid with the back rest, and of fluid-operated damper means between the support and the carrier. The damper means includes a first portion (e.g., a double-acting hydraulic cylinder) which is remote from the hinge and is connected with the support, and a second portion (e.g., a piston rod for the piston in the cylinder) which is remote from the hinge and is connected with the carrier. The first and second portions are movable relative to each other to permit pivoting of the back rest relative to the seat. The damper means further comprises means for releasably blocking the movements of the first and second portions relative to each other to thus maintain the back rest in a selected angular position with reference to the seat.

The hinge can be designed to directly connect the carrier with the support for the back rest, and the carrier is preferably provided with a suitable bracket or other means for articulately connecting the second portion of the damper means to the carrier. The blocking means can include a protuberance which is movably mounted on or in the second portion, and the chair further comprises means for moving the protuberance relative to the second portion of the damper means to thereby release the first and second portions for movement relative to each other, i.e., to release the back rest for pivotal movement relative to the seat. If the second portion comprises a piston rod, the protuberance can extend substantially axially of and beyond the piston rod. The moving means for the protuberance is preferably disposed beneath and adjacent one side of the seat, and such moving means can include a shaft which is rotatably mounted on the carrier and has a handle at the one side of the seat, and a cam which is provided on the shaft adjacent the protuberance and is movable by the shaft between at least one first position in which the blocking means releases the first and second portions of the damper means for movement relative to each other, and at least one second position in which the blocking means prevents movements of the first and second portions of the damper means relative to each other.

The shaft can be journalled in the aforementioned means for articulately connecting the second portion of the damper means to the carrier, and the chair preferably further comprises means (such as a leaf spring) for biasing the cam to the at least one second position in which the blocking means is operative to prevent movements of the first and second portions of the damper means relative to each other. The cam can be provided with at least one flat which is engaged by the biasing means in the at least one second position of the cam, and the cam can be further provided with at least one substantially convex surface which is engaged by the biasing means in the at least one first position of the cam. A portion of the biasing means can extend between the protuberance and the cam, i.e., the biasing means can actually transmit motion to the protuberance in response to turning of the cam by the shaft to move the cam to the at least one first position.

The chair preferably further comprises means for changing the level of the carrier, and means for actuating the level changing means. The level changing means can include a gas spring in the leg, and the actuating means can comprise a projection which is movably mounted on the gas spring and means for moving the projection with reference to the gas spring. The moving means is preferably disposed beneath and adjacent the other side of the seat, and such moving means can comprise a shaft which is rotatably mounted in or on the carrier, a handle which serves to rotate the shaft, and means for transmitting motion from the shaft to the projection in response to rotation of the shaft to at least one predetermined angular position. The motion transmitting means can comprise at least one cam on the shaft and a lever which is mounted in or on the carrier and is pivotable by the cam to thereby move the projection with reference to the gas spring. The lever can include a first arm which engages the at least one cam, and a second arm which engages the projection.

The novel features which are considered as characteristic of the invention are set forth in particular in the appended claims. The improved chair itself, however, both as to its construction and the mode of adjusting the same, together with additional features and advantages thereof, will be best understood upon perusal of the following detailed description of certain presently preferred specific embodiments with reference to the accompanying drawing.

BRIEF DESCRIPTION OF THE DRAWING

FIG. 3 is a fragmentary rear elevational view of the chair;

FIG. 4 is a top plan view of the chair, with portions of the seat broken away.

DESCRIPTION OF PREFERRED EMBODIMENTS

Figure 1:
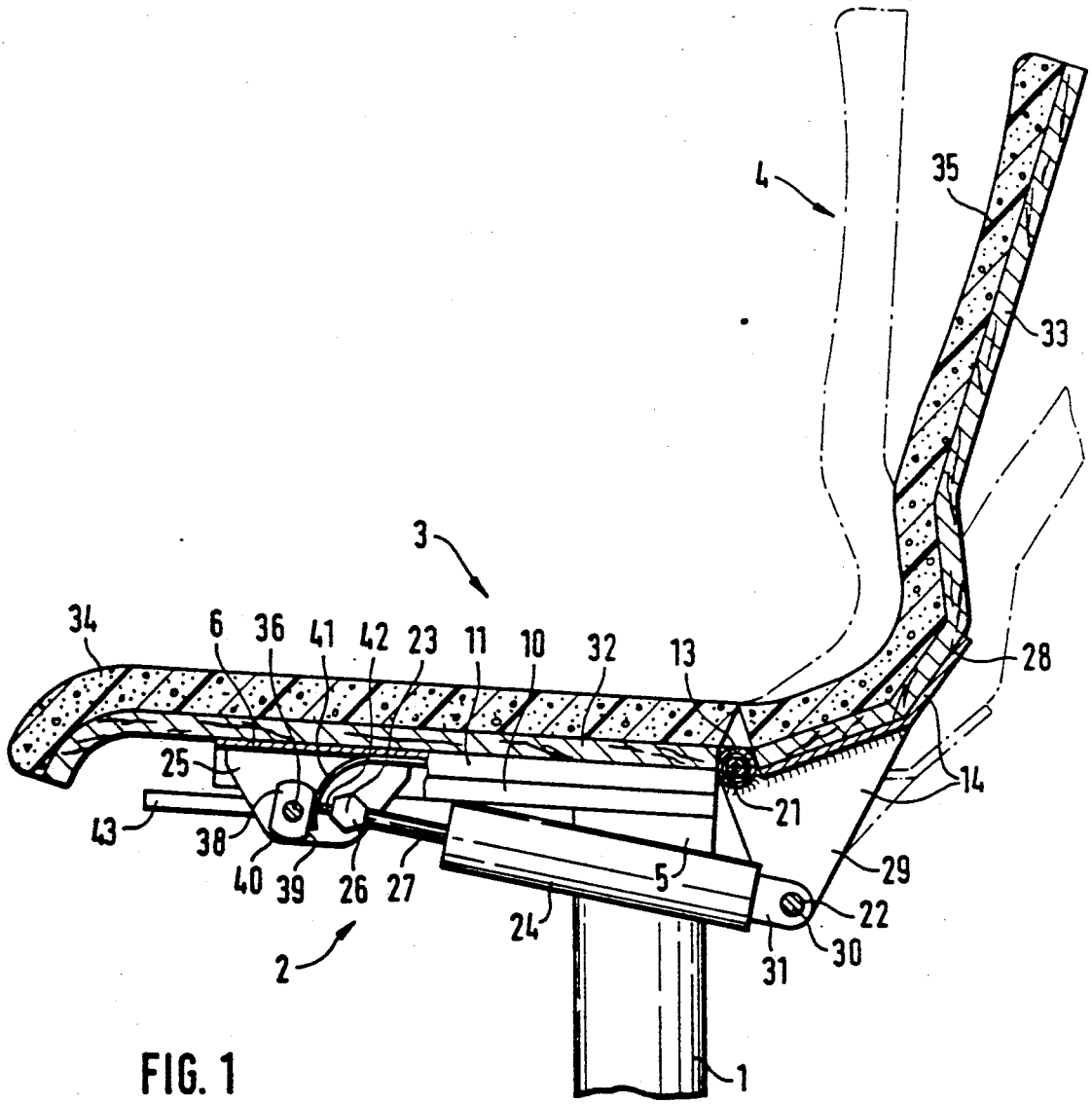
FIG. 1 a fragmentary partly left-hand side elevational and partly, central vertical sectional view of a chair which embodies one form of the invention, the back rest being shown in three different angular positions.

The improved chair comprises a leg having an upper portion 1 which is telescoped into a lower portion, and the lower portion of the leg is mounted on one or more feet. The upper portion 1 of the leg is rigidly connected with a carrier 2 which, in turn, is rigidly connected with a seat 3. The back rest 4 of the chair is pivotable relative to the seat 3 about a horizontal axis which is defined by a hinge 13 having a torque rod 21 which tends to pivot the back rest 4 forwardly, i.e., so that the back rest tends to move toward and (if necessary) beyond the phantom-line position of FIG. 1 which is tantamount to pivotal movement of the back rest to or beyond the phantom-line position of FIG. 2.

The carrier 2 comprises a relatively wide panel or plate 6 of metallic sheet material with downwardly bent marginal portions 11 along the sides of the seat 3. The carrier 2 further comprises a relatively short U-shaped member 5 having a web 7 which is welded or otherwise fixedly secured to the upper side of the upper portion 1 of the leg. The plate 6 is affixed to the seat 3. The major portion of the plate 6 may but need not be flat; this plate can follow the curvature (if any) of the underside of the seat 3. The upper end portions of the legs of the U-shaped member 5 are affixed to a depressed portion 8 of the plate 6. The web 7 and the depressed portion 8 have aligned openings for a hollow conical member 9 which is located between two mutually inclined sidewalls 10 of the depressed portion 8. The depressed portion 8 and its sidewalls 10 can be best seen in FIG. 4. The parts 1, 5 and 6 are preferably welded to each other.

The hollow conical member 9 in the parts 5 and 6 of the carrier 2 receives a complementary conical member at the upper end of a gas spring 12 which supports the carrier 2, the seat 3 and the back rest 4 and is installed in the leg. The gas spring 12 serves as a means for moving the carrier 2 between different levels, i.e., for changing the level of the carrier 2 (and hence of the seat 3 and back rest 4) when the occupant of the chair or another person elects to raise or lower the seat.

Figure 2:
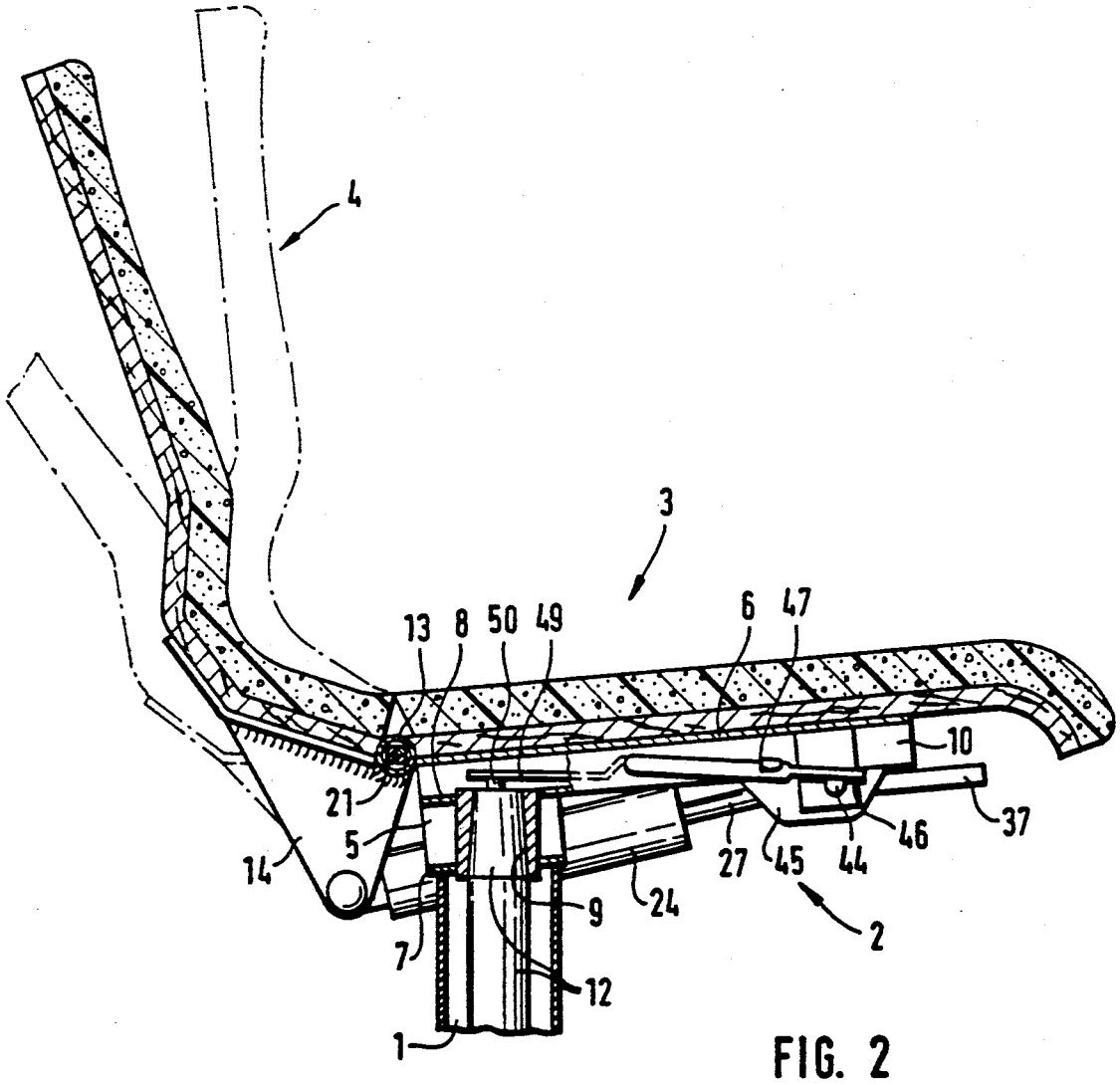
FIG. 2 is a fragmentary partly right-hand side elevational and partly central vertical sectional view of the chair which is shown in FIG. 1.

The lower portion of the back rest 4 is rigidly connected with a support 14 in the form of a bracket which constitutes one of two parts serving to movably couple the back rest 4 to the carrier 2. The other of these two parts is a fluid-operated damper 24 which operates between the support 14 and the carrier 2. The hinge 13 not only serves to bias the back rest 4 but constitutes a fulcral pivot which also directly connects the carrier 2 with the support 14. The welded seams which connect the hinge 13 with the plate 6 of the carrier 2 are shown in FIG. 4, as at 15, and the welded seam between the support 14 and the hinge 13 is shown at 16. The illustrated hinge 13 comprises a centrally located leaf which is welded to the support 14 (at 16), and two outer leaves which are welded (at 15) to the plate 6. The torque rod 21 of the hinge 13 serves to bias the centrally located leaf relative to the outer leaves in a direction to pivot the back rest 4 forwardly. The torque rod 21 reacts against the plate 6 and bears against the median or centrally located leaf. To this end, the torque rod 21 has a lever 17 which bears against a projecting portion 18 of the plate 6. The bias of the torque rod 21 can be changed by a screw 20 which is provided with a knob 19 and extends through a tapped bore (not shown) of the lever 17 to bear against the projecting portion 18 of the plate 6. The torque rod 21 preferably comprises four sections to that its characteristic curve is rather smooth, i.e., without abrupt transitions from increment to increment. The screw 20 can be rotated by way of the knob 19 to change the initial stressing of the torque rod 21, i.e., to select the force which tends to pivot the back rest 4 forwardly by determining the force with which the support 14 tends to turn in a counterclockwise direction as seen in FIG. 1 or in a clockwise direction as seen in FIG. 2.

The damper 24 is provided with means (shown as including a protuberance 42) for releasably blocking the movements of the first portion (cylinder) 31 and second portion (piston rod) 27 of the damper 24 relative to each other. The protuberance 42 normally extends axially of and beyond the exposed end portion or head 26 of the piston rod 27 and can be moved by a cam 38 to thereby enable the cylinder 31 to move relative to the piston rod 27 in a first direction (to the right, as seen in FIG. 1) under the bias of the torque rod 21 in order to pivot the back rest 4 forwardly, or in a second direction (to the left in FIG. 1) in order to enable the back rest 4 to pivot toward or even beyond its broken-line position (clockwise in FIG. 1) against the opposition of the torque rod 21. Such pivoting of the back rest 4 is effected by the back of the person occupying the seat 3 while the protuberance 42 of the blocking means is maintained in the depressed position.

The cylinder 31 of the damper 24 has a rearwardly extending lug having a hole 22 for a fulcral pivot in the form of a horizontal shaft 30 of the support 14 so that the damper 24 and the back rest 4 can turn relative to each other about the axis of the shaft 30. It will be noted that the lug of the cylinder 31 is remote from the hinge 13. The exposed end portion or head 26 of the piston rod 27 is articulately connected with the carrier 2 by a bearing block 25 which is rigid with the plate 6 and has two spaced-apart legs for the respective end portions of a horizontal pivot member. It is presently preferred to provide the end portion or head 26 of the piston rod 27 with a fulcral pivot comprising two coaxial stubs 23 each of which is journalled in one of the two legs forming part of the bearing block 25. The end portion or head 26 is remote from the hinge 13.

The support 14 includes a plate 28 of metallic sheet material which is slightly curved and is rigid with three spaced apart downwardly extending parallel arms 29. The arms 29 are welded to the plate 28 and their lower end portions are connected to each other by the aforementioned shaft 30 for the lug of the cylinder 31. The lug can resemble or constitute an eyelet (see particularly FIG. 3) which has the hole 22 for the shaft 30 between two of the downwardly extending arms 29 of the support 14.

The seat 3 comprises a base element 32 which can be made of plywood and supports a preferably detachable cushion 34. The base element 32 is secured to the upper side of the plate 6 and is suitably profiled. The cushion 34 follows the curvature of the upper side of the base element 32 to provide a comfortable seating facility for the occupant. Analogously, the back rest 4 comprises a base element 33 which can be made of plywood and is profiled to determine the shape of a cushion 35. As can be seen in FIG. 1, the torque rod 21 of the hinge 13 extends upwardly beyond the plate 6 of the carrier 2 and is located between the adjacent edge faces of the base elements 32 and 33. This reduces the effective width of the gap between the base elements 32, 33 but still enables the base element 33 to pivot about the axis of the hinge 13 without touching the base element 32.

As mentioned above, the means for moving the protuberance 42 of the blocking means for the damper 24 includes a cam 38. This cam is affixed to a shaft 36 which is provided with a handle 37 adjacent one side of the seat 3. The shaft 36 is rotatably journalled in the bearing block 25 on the carrier 2, and the cam has two parallel flats 39 as well as two convex surfaces 40 which alternate with the flats 39 in the circumferential direction of the shaft 36. A leaf spring 41 is affixed to the plate 6 and its free end portion extends between the cam 38 and the protuberance 42 so that it bears against one of the flats 39 or against one of the convex surfaces 40, depending upon the selected angular position of the shaft 36. The cam 38 is located between the two legs of the bearing block 25. The center of curvature of each convex surface 40 on the cam 38 is located on the axis of the shaft 36.

The leaf spring 41 stores energy when the handle 37 is caused to turn the shaft 36 in a clockwise or in a counterclockwise direction, namely when the operator of the handle 37 causes one of the convex surfaces 40 to come into engagement with the adjacent free end portion of the leaf spring 41. The leaf spring 41 then depresses the protuberance 42 and unblocks the damper 24 so that the latter permits the torque rod 21 to pivot the back rest 4 forwardly, or the occupant of the seat 3 can lean back to pivot the back rest 4 rearwardly against the opposition of the torque rod 21. The handle 37 can further cause the one or the other convex surface 40 of the cam 38 to slide along the leaf spring 41 and the latter is then free to dissipate energy. The cam 38 normally comes to a halt when the leaf spring 41 reengages one of the flats 38. This is one of the two stable angular positions of the shaft 36 and cam 38 in which the leaf spring 41 enables the protuberance 42 to assume its extended position and to ensure that the blocking means prevents movements of the piston rod 27 and cylinder 31 relative to each other, i.e., the damper 24 is blocked and the back rest 4 is maintained in the selected angular position with reference to the seat 3.

The means for moving the protuberance 42 can be designed in such a way that the leaf spring 41 automatically engages one of the flats 39 when the handle 37 is released.

The means for changing the level of the carrier 2 (i.e., of the seat 3 and of the back rest 4) comprises the aforementioned gas spring 12 in the leg. The means for unblocking the gas spring 12 comprises a projection 50 (FIGS. 2 and 4) which extends upwardly beyond the hollow cone 9 in the carrier 2 and can be moved (depressed) by the respective arm 49 of a lever 47. This lever forms part of or constitutes a means for transmitting motion from a horizontal shaft 44 to the projection 50. The shaft 44 is rotatably journalled in a bearing member 45 which is affixed to the carrier 2, and the shaft is preferably coaxial with or parallel to the shaft 36 and carries a handle 43 adjacent the other side of the seat 3 opposite the handle 37 for the shaft 36. The bearing member 45 has two downwardly extending arms flanking a small plate cam 46 which is welded to the shaft 44 (the latter is rotatably journalled in the two legs of the bearing member 45). The plate cam 46 comprises two small lobes which make an obtuse angle. The arm 49 of the lever 47 is adjacent the projection 50 on the gas spring 12, and the other arm of this lever can be pivoted by the plate cam 46 on the shaft 44 to thereby enable the arm 49 to depress the projection 50 and thus enable the gas spring 12 to change the level of the carrier 2, seat 3 and back rest 4. A portion of the lever 47 is pivotably mounted in the sidewalls 10 of depressed portion 8 of the plate 6, as at 48. The arm 49 of the lever 47 preferably includes or constitutes a relatively wide plate (see particularly FIG. 4) which overlies the projection 50. For example, the plate of the arm 49 can be welded to the major part of the lever 47.

If the occupant of the chair wishes to change the level of the carrier 2, the handle 43 is engaged to turn the shaft 44 whereby one lobe of the plate cam 46 between the legs of the bearing member 45 pivots the lever 47 and the arm 49 depresses the projection 50 to activate the gas spring 12 and to enable the occupant to effect an upward or downward movement of the upper portion 1 of leg together with the carrier 2, seat 3 and back rest 4.

An important advantage of the improved chair is its simplicity. This is attributable to the feature that the hinge 13 not only enables the back rest 4 to pivot with reference to the carrier 2 but also comprises means (torque rod 21) for permanently biasing the back rest 4 and for actually pivoting the back rest forwardly as soon as the blocking device including the protuberance 42 unblocks the damper 24 so that the cylinder 31 is free to move axially with reference to the piston rod 27. Furthermore, the means for coupling the back rest 4 to the carrier 2 of the seat 3 consists of only 2 parts, namely the support 14 and the damper 24.

Another important advantage of the improved chair is that the hinge 13 occupies little room (it is installed between the base elements 32 and 33 of the seat 3 and back rest 4, respectively) and directly connects the support 14 to the carrier 2. It can be said that the mechanism beneath the seat 3 and back rest 4 merely comprises three main components which are articulately connected to each other, namely the carrier 2, the support 14 and the damper 24.

An advantage of the feature that the protuberance 42 of the means for releasably blocking the damper 24 is disposed beneath and rather close to the front portion of the seat 3 is that the handle 37 can be located in an optimum position for convenient engagement by one hand of the person occupying the seat. Moreover, the operative connection between the handle 37 and the protuberance 42 is short and simple.

The leaf spring 41 performs several desirable functions. Thus, this spring cooperates with the cam 38 to normally ensure that the blocking means including the protuberance 42 can prevent axial movements of the cylinder 31 relative to the piston rod 27 of the damper 24. The cam 38 is simple and inexpensive; it merely comprises one or more flats 39 and one or more convex surfaces 40 whereby one of the flats 39 cooperates with the leaf spring 41 to normally hold the shaft 36 in an angular position in which the blocking means for the damper 24 is effective to maintain the back rest 4 in a selected angular position. Thus, it is not necessary to provide specially designed stop means for locking or maintaining the shaft 36 in a predetermined angular position in which the damper 24 is blocked. In addition, the free end portion of the leaf spring 41 between the cam 38 and the protuberance 42 ensures that the protuberance is stressed only in the axial direction of the piston rod 27. This is due to the fact that the cam 38 cannot directly engage the protuberance 42, i.e., the cam cannot tend to tilt or to otherwise change the orientation of the protuberance with reference to the piston rod 27. Frictional engagement takes place only between the cam 38 and the leaf spring 41 but not between the leaf spring 41 and the protuberance 42. This renders it possible to design the cam 38 in such a way that the transitions from the flats 39 into the convex surfaces 40 and vice versa are abrupt.

As mentioned above, the centers of curvature of the convex surfaces 40 of the cam 38 are preferably located on the axis of the shaft 36. This is desirable and advantageous because, once the free end portion of the leaf spring 41 is engaged by any part of either of the two convex surfaces 40, the protuberance 42 is properly depressed and its axial position does not change as long as the free end portion of the leaf spring 41 continues to remain in engagement with one of the convex surfaces 40. Such design of the cam 38 reduces the likelihood of jamming of the protuberance 42. Moreover, the convex surfaces 40 render it possible to release the handle 37 when one of the convex surfaces engages the leaf spring 41, i.e., the occupant of the seat 3 can move her or his hand away from the handle 47 without necessarily and automatically causing a return movement of the protuberance 42 to its extended position in which the damper 24 is blocked. This enables the occupant of the seat 3 to grasp the seat with both hands while using her or his back as a means for pivoting the back rest 4 against the opposition of the torque rod 21. In other words, the back rest 4 remains adjustable as long as the occupant desires, i.e., until the occupant decides to actuate the handle 37 for the purpose of moving one of the flats 39 on the cam 38 into engagement with the adjacent free end portion of the leaf spring 41.

It goes without saying that the illustrated means 36 to 41 for depressing the protuberance 42 (i.e., for unblocking the damper 24) constitutes but one of a plurality of suitable depressing means. The same holds true for the means (including the handle 43) for depressing the projection 50 in order to enable a person to change the level of the carrier 2, seat 3 and back rest 4.

Figure 5:
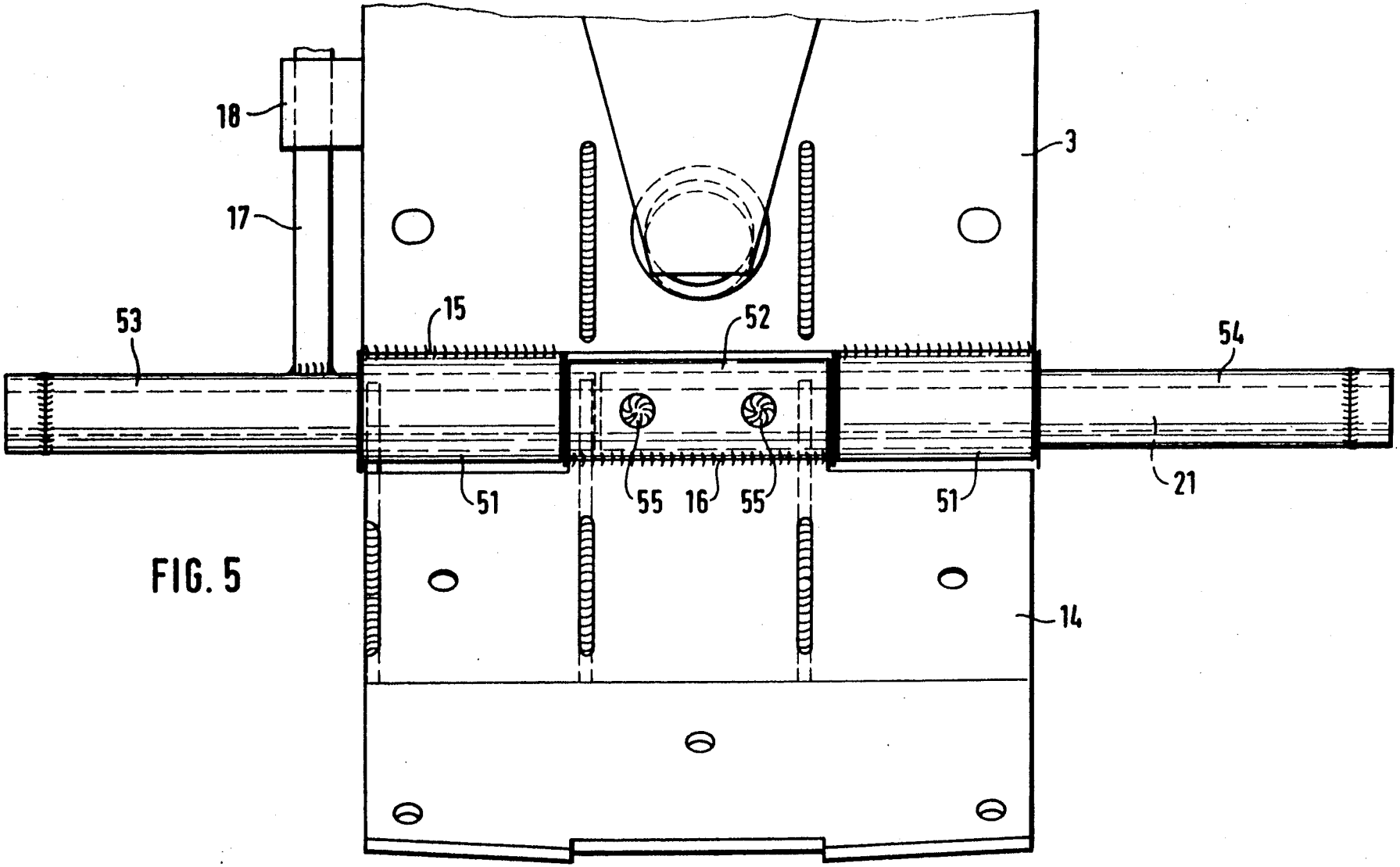
FIG. 5 is an enlarged view of a detail in FIG. 4.

One presently preferred form of the hinge 13 is shown in greater detail in FIG. 5. The two outer leaves of this hinge are constituted by sleeves 51 which are welded to the plate 6, as at 15, and the central leaf is constituted by a sleeve 52 which is welded to the support 14, as at 16. The sleeves 51 are coaxial with the sleeve 52, and each of the sleeves 51 surrounds a pipe 53, 54. The pipe 53 is coaxial with the pipe 54, the pipe 53 is rotatable in the left-hand sleeve 51 and is welded to the adjacent end of the lever 17 as well as to the respective end of the torque rod 21, and the pipe 54 is rotatable in the right-hand sleeve 51 and is welded to the sleeve 52 (at 55) and to the respective end portion of the torque rod 21.

The transmission of force takes place from the pipe 53, by way of the torque rod 21, pipe 54 and sleeve 52, to the support 14.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

A gas spring with projection which can be used in the improved chair is manufactured by Stabilus GmbH of Koblenz, Federal Republic Germany and is known as STAB-0-MAT I, Typ 08 11 1023 25 135 GDTY. A damper with a protuberance which can be used in the improved chair is manufactured also by Stabilus GmbH of Koblenz, Federal Republic Germany and is known as HYDRO-BLOC, Typ 06 61 1024 25 023.

We claim:

1. A chair having a total of three fulcral pivots and comprising a leg having an upper portion; a seat having a profiled first base element; a first cushion provided on and following the profile of said first base element; a back rest having a second profiled base element, said base elements having adjacent edge faces; a second cushion provided on and following the profile of said second base element; a carrier connecting said seat to the upper portion of said leg, said carrier being rigid with said upper portion and with said seat; a first fulcral pivot including a hinge disposed between said edge faces and pivotally mounting said back rest on said carrier and including means for biasing said back rest forwardly; and means for movably coupling said back rest to said carrier, said coupling means consisting of a support rigid with said back rest, hydraulic damper means disposed between said support and said carrier and spaced apart from said back rest a second fulcral pivot connecting said damper means to said support, and a third fulcral pivot connecting said damper means to said carrier.

2. The chair of claim 1, wherein said damper means includes a first portion remote from said hinge and connected with said support by said second fulcral pivot, and a second portion remote from said hinge and connected with said carrier by said third fulcral pivot, said first and second portions being movable relative to each other to permit pivoting of said back rest relative to said seat.

3. The chair of claim 2, wherein one of said first and second portions includes a cylinder and the other of said first and second portions includes a piston rod.

4. The chair of claim 2, wherein said damper means further comprises means for releasably blocking the movements of said first and second portions relative to each other to thus maintain the back rest in a selected angular position with reference to said seat.

5. The chair of claim 4, wherein said hinge directly connects said carrier with said support.

6. The chair of claim 4, further comprising means for articulately connecting said second portion to said carrier said blocking means including a protuberance movably mounted on said second portion and further comprising means for moving said protuberance relative to said second portion to thereby release said first and second portions for movement relative to each other.

7. The chair of claim 6, wherein said second portion includes a piston rod and said protuberance extends substantially axially of and beyond said piston rod.

8. The chair of claim 6, wherein said seat has a first side and a second side and said moving means is disposed beneath and adjacent one side of said seat.

9. The chair of claim 8, wherein said moving means includes a shaft rotatably mounted on said carrier and having a handle at said one side of said seat, and a cam provided on said shaft adjacent said protuberance and movable by said shaft between at least one first position in which said blocking means releases said first and second portions for movement relative to each other, and at least one second position in which said blocking means prevents movements of said first and second portions relative to each other.

10. The chair of claim 9, wherein said shaft is journalled in said connecting means.

11. The chair of claim 9, further comprising means for biasing said cam to said at least one second position.

12. The chair of claim 4, further comprising means for changing the level of said carrier and means for actuating said level changing means.

13. The chair of claim 12, wherein said level changing means includes a gas spring in said leg and said actuating means comprises a projection movably mounted on said gas spring and means for moving said projection with reference to said gas spring.

14. The chair of claim 13, wherein said seat has a first side and a second side and said moving means is disposed beneath said seat adjacent one of said sides and includes a shaft rotatably mounted in said carrier means for rotating said shaft, and means for transmitting motion from said shaft to said projection in response to rotation of said shaft to at least one predetermined angular position.

15. The chair of claim 14, wherein said motion transmitting means comprises at least one cam on said shaft and a lever mounted on said carrier and pivotable by said cam to thereby move said projection.

16. The chair of claim 15, wherein said lever includes a first arm which engages said at least one cam and a second arm which engages said projection.

17. The chair of claim 16, wherein said second arm includes a plate.

18. A chair comprising a leg having an upper portion; a seat having a first side and a second side and including a first base element; a back rest having a second base element, said base elements having adjacent edge faces; a carrier connecting said seat to the upper portion of said leg, said carrier being rigid with said upper portion and with said seat; a hinge disposed between said edge faces and pivotally mounting said back rest on said carrier and including means for biasing said back rest forwardly; means for movably coupling said back rest to said carrier, said coupling means consisting of a support rigid with said back rest and hydraulic damper means connected between said support and said carrier and spaced apart from said back rest, said damper means including a first portion remote from said hinge and connected with said support, and a second portion remote from said hinge and connected with said carrier, said first and second portions being movably relative to each other to permit pivoting of said back rest relative to said seat, said damper means further including means for releasably blocking the movements of said first and second portions relative to each other to thus maintain the back rest in a selected angular position with reference to said seat; means for articulately connecting said second portion to said carrier, said blocking means including a protuberance movably mounted on said second portion; means for moving said protuberance relative to said second portion to thereby release said first and second portions for movement relative to each other, said moving means being disposed beneath and adjacent one side of said seat and including a shaft rotatably mounted on said carrier and having a handle at said one side of said seat, and a cam provided on said shaft adjacent said protuberance and movable by said shaft between at least one first position in which said blocking means releases said first and second portions for movement relative to each other and at least one second position in which said blocking means prevents movements of said first and second portions relative to each other; and means for biasing said cam to said at least one second position, said means for biasing said cam including a leaf spring and said cam including a flat which is engaged by said spring in the at least one second position of the cam.

19. The chair of claim 18, wherein said cam further comprises a substantially convex surface which is engaged by said spring in the at least one first position of said cam.

20. The chair of claim 19, wherein said spring includes a portion between said cam and said protuberance.

* * * * *

UNITED STATES PATENT AND TRADEMARK OFFICE

CERTIFICATE OF CORRECTION

PATENT NO. : 5,069,496

DATED : December 3, 1991

INVENTOR(S) : Günther KUHN et al.

It is certified that error appears in the above-identified patent and that said Letters Patent is hereby corrected as shown below.

On the title page:
[76] Inventors: "Kunh" should read --Kuhn--.
[57] Abstract: line 4, after "by" insert --a--.

Signed and Sealed this

Thirty-first Day of August, 1993

Bruce Lehman

*Attest:*

BRUCE LEHMAN

*Attesting Officer*

*Commissioner of Patents and Trademarks*